US007975772B2

(12) United States Patent
Guven

(10) Patent No.: US 7,975,772 B2
(45) Date of Patent: Jul. 12, 2011

(54) METHOD AND SYSTEM OF HYDRAULIC CONTROL LINE CONNECTION

(75) Inventor: Oguzhan Guven, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 91 days.

(21) Appl. No.: 12/348,442

(22) Filed: Jan. 5, 2009

(65) Prior Publication Data

US 2009/0277646 A1 Nov. 12, 2009

Related U.S. Application Data

(60) Provisional application No. 61/051,949, filed on May 9, 2008.

(51) Int. Cl.
*E21B 41/00* (2006.01)
*H01S 4/00* (2006.01)

(52) U.S. Cl. ..... 166/380; 166/242.6; 174/88 R; 174/110 E; 29/592.1

(58) Field of Classification Search ..... 166/380, 166/65.1, 242.6; 174/88 R, 110 E, 110 SR; 29/592.1, 825
See application file for complete search history.

(56) References Cited

U.S. PATENT DOCUMENTS

| | | | | |
|---|---|---|---|---|
| 6,886,638 | B2 | 5/2005 | Ahmed | |
| 6,919,512 | B2 | 7/2005 | Guven | |
| 7,154,413 | B2 | 12/2006 | Veneruso | |
| 7,340,819 | B2 | 3/2008 | Guven | |
| 2010/0051130 | A1 * | 3/2010 | Syse et al. | 138/89 |

* cited by examiner

*Primary Examiner* — William P Neuder
(74) *Attorney, Agent, or Firm* — Brandon S. Clark; Rodney Warfford

(57) ABSTRACT

A method of coupling a first control line to a second control line is provided comprising the steps of prepping the first and second control lines to respectively produce a first end and a second end. Prepping may comprise inserting a plug assembly into at least one of the first or second ends prior to facing the end containing the plug assembly. The method may further include butt-welding the first end to the second end to form a splice and providing a protective assembly to cover the splice. The plug assembly may comprise a plug member, a seal, and an end piece to couple the seal to the plug member, in some embodiments. In other embodiments, the plug assembly may comprise a plug member and a seal coupled to the plug member.

19 Claims, 4 Drawing Sheets

METHOD AND SYSTEM OF HYDRAULIC CONTROL LINE CONNECTION

RELATED APPLICATIONS

This application claims the benefit of U.S. Provisional Application No. 61/051,949, titled "METHOD AND SYSTEM OF HYDRAULIC CONTROL LINE CONNECTION," filed May 9, 2008, the contents of which are herein incorporated by reference.

BACKGROUND

1. Field of the Invention

Embodiments of the present invention relate generally to methods of making tubing connections and more particularly to methods of making connections between hydraulic control lines such as those used in downhole applications.

2. Description of the Related Art

The following descriptions and examples are not admitted to be prior art by virtue of their inclusion in this section.

Hydraulic fluid is widely used to communicate with and/or actuate various downhole tools and components. One means of conveying the hydraulic fluid to the tools and components is through the use of various diameters (¼", ½" etc) of hydraulic control lines selected according to the particular application. The control lines are typically seamless or seam-welded continuous metal tubes with various wall thicknesses (0.035", 0.049", etc). Since a control line may provide communication and hydraulic power between various tools or between the wellhead and the tools, some control lines can be pressure rated for up to 25 Ksi or more. When a control line is used in a downhole application, reliability is critical (i.e., no fluid leaks along the length of a control line). One area of concern in terms of reliability is with the termination to downhole tools and wellheads as well as with the individual splice connections (when present). Tool terminations and splices are traditionally done using hydraulic fittings that rely on metal-to-metal seals. However, this involves an increased risk due at least in part to the introduction of two potential leak paths via the two metal-to-metal primary seals per splice connection, along with the associated cost of storage of an inventory of couplings that must be made to relatively strict tolerances.

SUMMARY

In accordance with an embodiment of the present invention, a method of coupling a first control line to a second control line may comprise prepping the first and second control lines to respectively produce a first end and a second end, such as through facing. A plug may be inserted during the prepping step in order to prevent contamination of the fluid contained in the control line. Another step in the method may be butt-welding the first end to the second end to produce a splice. Additionally, the method may include providing a protective assembly to protect the splice between the first end and the second end.

In accordance with another embodiment of the present invention, the plug assembly may comprise a plug member and a seal member configured to be translateably accommodated within the interior of the control line. The plug assembly may be removed prior to joining the first end to the second end.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Figure 1:
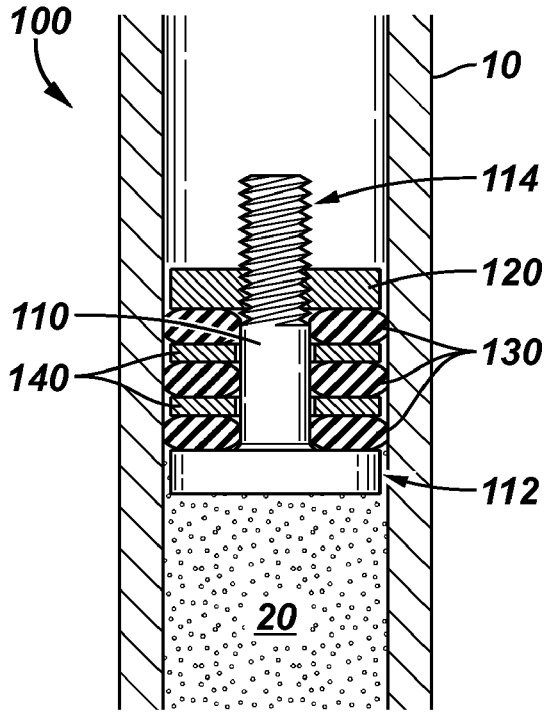
FIG. 1 is a cross-sectional view of a plug assembly provided in the end of a control line, in accordance with an embodiment of the invention.

In the following description, numerous details are set forth to provide an understanding of the present invention. However, it will be understood by those of ordinary skill in the art that the present invention may be practiced without these details and that numerous variations or modifications from the described embodiments may be possible. In the specification and appended claims: the terms "connect", "connection", "connected", "in connection with", "connecting", "couple", "coupled", "coupled with", and "coupling" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention.

In the following description, numerous details are set forth to provide an understanding of the present invention. However, it will be understood by those skilled in the art that the present invention may be practiced without these details and that numerous variations or modifications from the described embodiments are possible.

Embodiments of the present invention may include joining methods of creating tool terminations and splices for control line applications. For example, in a splice connection two control line ends may be butt-welded together. In the case of a tool termination, an exemplary embodiment may be an end of a control line welded to a machine profile comprising substantially the same geometry as the control line itself. In the interest of brevity, only the control line splices will be explained in the detailed description that follows. However, a person of skill in the art will recognize that the same steps may also be used in other embodiments and situations, for example, such as in tool terminations.

Welded control line splices or tool terminations may be done either in the field or in the shop. Embodiments of the present invention may include any or all of the following steps, although not necessarily in the order presented. The method for creating a welded connection may comprise the following steps: prepping a control line for welding; butt-welding the control line ends to couple the control lines together; and protecting the welded seam. Each of these steps will be explained in more detail.

An embodiment of a method designed to couple two control lines together may comprise prepping the control lines for welding. In a situation in which the welding is a form of butt-welding, the prepping may involve facing the control line ends such that they are orthogonal to the respective axis of the control line. This process should preferably leave the ends with a flat or relatively planar surface comprising sharp edges in some cases. There are commercially available tools configured for this purpose. However, these tools don't offer any means of keeping any fluid contained within the control line (e.g., such as when the joining is performed at a field location in which the control lines are run downhole while containing fluid) clean, or free from cuttings or filings produced by the prepping process. In some embodiments of this invention, techniques and associated tools are described in order to achieve control line end facing without resulting in any contamination of the fluid contained therein. Accordingly, prepping may comprise at least some of the following steps: removing a small amount of fluid from the control line, inserting a plug into the control line, facing the end, and retrieving the plug.

Control line prepping may comprise facing the end of a control line orthogonal to its axis while keeping any control line fluid clean and free from the associated cuttings or filings (i.e., debris) that may be produced during the prepping. In order to reduce the risk of contamination (e.g., such as fluid contamination or control line contamination in situations in which no fluid is contained within the control line at the time of prepping), a plug assembly 100, as shown in FIG. 1, may be used. The plug assembly 100 may be inserted into a control line 10 in such a way that the end of the control line is free from interference during a subsequent prepping process. In some cases, the control line 10 may contain fluid 20, such as hydraulic fluid for example.

The plug assembly 100 may comprise a plug member 110, an end piece 120, and one or more sets of seals 130 along with a related number of spacers 140. The plug member 110 may comprise a first plug end 112 and a second plug end 114. The first plug end 112 may be in the form of a cylindrical disk configured to translatably fit within the interior of a control line 10. Although a uniform cylindrical disk is shown as an example of the first plug end 112 of the plug member 110, embodiments of the invention may not be limited to this geometric configuration. Many variations and modifications are considered within the scope of the current invention, such as, but not limited to, arcuate and angled end surfaces to more easily engage with and enter into the control line 10, and separate first plug ends coupled to the remaining portion of the plug member 110 via threads, etc., among others. One surface of the first plug end 112 may be adjacent to the control line fluid 20 while the other surface may be proximate to a seal 130.

The second plug end 114 of the plug member 110 may be threaded as shown in this illustrative embodiment. The threads of the second plug end 114 may be used for coupling with the end piece 120 and/or a retrieval tool to be described later. In some embodiments the end piece 120 may be removably fastened to the second plug end 114 of the plug member 110. However, in still other cases, the end piece 120 may be permanently fastened to the plug member 110 via welding, brazing, chemical adhesive, etc., among other methods of fastening. The end piece 120 may be configured to translatably fit within the interior of the control line 10. Although the end piece 120 is shown as similar to the first plug end 112 in this exemplary embodiment, other embodiments of the invention may not be limited to this configuration. As with the first plug end 112, many variations and modifications of the end piece 120 are considered to be within the scope of the current invention.

An embodiment of the second plug end 114 is illustrated as a uniform threaded surface configured to couple with both the end piece 120 and the retrieval tool (described and shown later). However, in some cases, the coupling method for the end piece 120 may be different than the coupling method used for the retrieval tool. For example, different diameters of the threaded portions may be used for the end piece 120 and the retrieval tool or different attachment methods such as using treads to couple the end piece 120 to the plug member 110 and a recessed groove or hook and eye type of configuration to attach the retrieval tool, among others. Further, in this exemplary embodiment, the end piece 120 is shown as a separate component from the plug member 110 while the first plug end 112 is integral with the plug member 110. However, in some situations, embodiments of both the end piece 120 and first plug end 112 may be separate components relative to the plug member 110, or both may be integral with the plug member 110. Alternatively, the first plug end 112 may be separate from the plug member 110 while the end piece 120 is integral with the plug member 110.

In the figure, three sets of seals 130 along with two spacers 140 are shown contained about a central shaft of the plug member 110, but embodiments of the present invention may not be limited to this illustrative configuration. One, two, or four or more sets of seals 130 may be used in a plug assembly along with an associated number of spacers 140, or in some cases, no spacers 140 at all. In still other situations, a plug assembly 100 may be configured to comprise more spacers 140 than seals 130 or the same number of spacers 140 and seals 130. Embodiments of the spacers 140 may comprise washers, for example, configured to fit within the control line 10, among other configurations.

Although the seals 130 and spacers 140 are shown as separate components from the plug member 110, the spacers 140 may be integral to the plug member 110. In some embodiments, the central shaft of the plug member 110 may be configured with a series of grooves allowing for the placement of o-rings to act as seals 130 (described later). In still other embodiments, the seals 130 may be proximate to one another without any spacing there between. The seals 130 may function to prevent or inhibit control line fluid 20 from flowing around the plug assembly 100. In some cases, the seals 130 may act as wipers as they move debris and other contaminants out of the interior of the control line 10 during removal.

As currently configured in FIG. 1, the plug assembly 100 may be assembled by placing the sets of seals 130 and spacers 140 onto the central shaft of the plug member 110, and retaining the sets with the end piece 120. If a single plug assembly 100 begins to wear, the end piece 120 may be rotated to modify the amount of expansion of the seals 130 as the end piece 120 and the first plug end 112 are drawn closer to one another. The more compression placed upon the seals 130, the tighter the fit of the plug assembly 100 relative to the interior of the control line 10.

A plug assembly 100 may be placed within the interior of a control line 10. In some situations, it may be necessary to remove a quantity of fluid 20 (where present) from the control line 10 in order to accommodate the plug assembly 100. The plug assembly 100 may be provided such that the end of the plug assembly 100 is below the end surface of the control line 10 (i.e., the plug assembly 100 may be completely within the control line 10). Once the plug assembly 100 is in place, the end of the control line 10 may be face. When the end of the control line 10 is faced (e.g., using a cutting tool), contaminates such as cuttings and filings should be captured above the plug assembly 100. To increase the confidence of the cleanliness of the interior of the control line 10, such as with the control line fluid 20 remaining within the control line 10, two or more plug assemblies 100 may be installed in tandem with one another.

Figure 2:
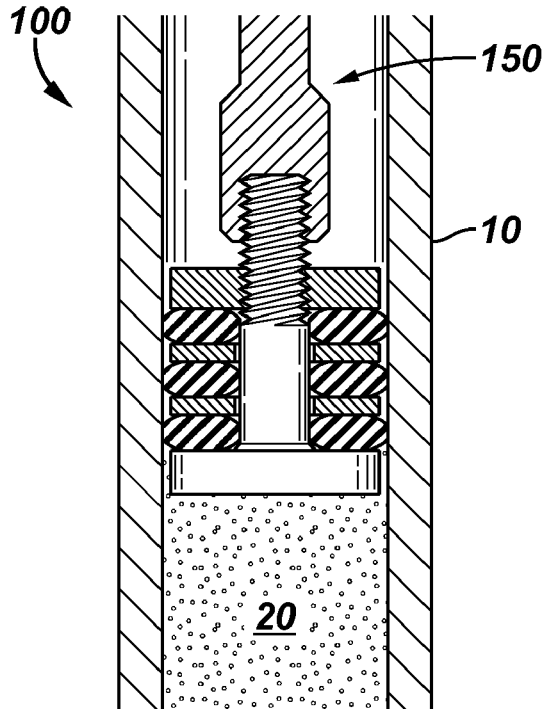
FIG. 2 is a cross-sectional view of the plug assembly of FIG. 1 attached to a retrieving tool, in accordance with an embodiment of the invention.

After the end of the control line 10 is faced, the plug assembly(ies) 100 may be removed using a retrieving tool, such as the threaded retrieving tool 150 shown in FIG. 2. During the removal of the plug assembly 100, the control line 10 may be oriented in an upright position in order to prevent any control line fluid 20 (if present) from flowing out of the control line 10 and potentially contaminating the weld area. In addition to the threaded attachment between the retrieval tool 150 and the plug assembly 100 shown in FIG. 2, the two components may be coupled together via a variety of mechanisms, including, but not limited to, snap fit assemblies, magnetic attraction, hook and eye mechanisms, or clamping mechanisms, among others.

An embodiment of a method designed to couple two control lines together may comprise butt-welding the control line ends in order to join the control lines together. In some embodiments, butt-welding may be done using an orbital arc welder for example. A dedicated weld program, which controls weld parameters (e.g., current, pulse rate, electrode placement and speed etc), may be required for each variation of control line diameter and wall thickness. In order to increase the reliability and integrity of the weld, it may also be important to keep control line fluid away from the weld area.

Prior to welding, the two control line ends may be placed proximate to one another. A control line with control line fluid (e.g., such as may occur if welding at a field location for example) should be kept upright and special attention should be given in order to prevent contamination of the weld area due to the fluid. A weld fixture may be used in order to maintain the proximity of one control line end with another control line end. The welding process may then be performed with regard to the predetermined weld parameters for the specific control lines being coupled together.

Figure 3:
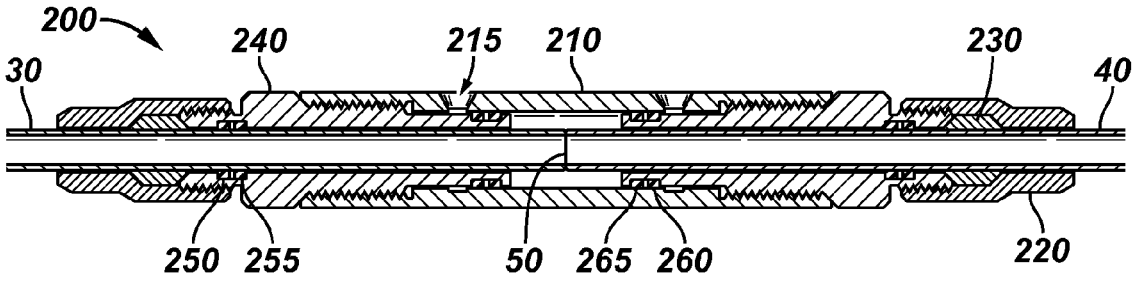
FIG. 3 is a cross-sectional view of a protective assembly located about a butt-weld of two control lines, in accordance with an embodiment of the invention.

An embodiment of a method designed to couple two control lines together may additionally comprise protecting the splice coupling the control lines. Protecting a welded splice 50 comprising a first control line 30 and a second control line 40 may include providing a protective assembly 200, such as the one shown in FIG. 3, around the welded splice 50. An illustrative embodiment of the protective assembly 200 may include a housing 210 surrounding the control line splice 50, retention members 220, compression members 230, and sealing members 240. The sealing members 240 may comprise first and second control line seals 250 and 255, and first and second housing seals 260 and 265. The protective assembly 200 may be configured to be substantially symmetrical about a centerline.

The housing 210 may surround the control line splice 50 and provide protection of the weld from bending, torsional, and/or tensile loads. In addition, the housing 210 may be used as a pressure test member in order to test the sealing integrity of the control line splice 50 via orifices 215. In some cases, embodiments of the present invention may have protective housing assemblies 200 configured to act as a secondary seal in the event of a failure of the control line splice 50. In other cases, the interior of the housing 210 may be filled via orifices 215 with an insulative, protective, or sealing material.

Sealing members 240 may be translatably coupled to the first and second control lines 30, 40. Each of the sealing member 240 may further be coupled with an end of the housing 210. The sealing members 240 are shown as being threadably coupled with respective ends of the housing 210 in this illustrative example, however, other coupling methods are within the scope of embodiments of this invention. In some embodiments, the sealing members 240 may be configured such that at least two positions are possible with respect to the housing 210 (however, only one position is shown in the figure). The first and second housing seals 260, 265 may sealingly engage with an interior surface of the housing 210 to one side or another (in an axial direction) of a corresponding orifice 215 also provided in the housing 210. In the position shown in the figure (i.e., the first and second housing seals 260, 265 are closer to the control line splice 50 than the respective orifice 215), the interior of the housing 210 is sealed from the surrounding environment. However, in a second position (i.e., in which the first and second housing seals 260, 265 are farther away from the control line splice 50 than the respective orifice 215, this position is not shown) the orifice 215 provides a pathway allowing communication between the exterior environment and the interior of the housing 210. In the second position, the control line splice 50 may be pressure tested and/or the interior area of the housing 210 filled with material.

Each sealing member 240 may further comprise first and second control line seals 250, 255. The first and second control line seals 250, 255 may translatably engage an exterior circumference of the corresponding first and second control lines 30, 40. As with the first and second housing seals 260, 265, some embodiments of the first and second control line seals 250, 255 may comprise a resilient member and retention assembly, such as an o-ring and holder. In other embodiments, a single sealing member may be used in place of the first and second seals 250, 255. Redundant seals may also be used to provide further sealing capacity when needed. In addition, the number of seals used to seal against the interior surface of the housing 210 may be different than the number of seals used to seal against the outer circumference of the control lines. When the sealing members 240 are each coupled with the housing 210 in the positions shown in FIG. 3, the splice 50 may be sealed from an external environment surrounding the protective housing 200.

Coupled to an end of each sealing member 240 may be a retention member 220. Captured between the sealing member 240 and the corresponding retention member 220 may be a compression member 230. As the retention member 220 is drawn closer relative to the sealing member 240, the captured compression member 230 may be compressed. Raising the level of compression applied to the compression member 230 may result in increasing the amount of pressure applied to the corresponding control line. The increased pressure may in turn increase the hold provided or resistance to movement (relative to the control line) via metal-to-metal contact against an exterior circumference of the control line. Conversely, when the retention member 220 is loosely coupled with a sealing member 240, the protective assembly 200 may be able to translate relative to the first and second control lines 30, 40. By securing both sets of retention members 220 and sealing members 240, the control line splice 50 may be relatively isolated from load, vibration, and shock applied to the control lines and other associated downhole components.

All of the components of the protective assembly 200 may be placed on one or both of the first and second control lines 30, 40 prior to butt-welding or joining the two control lines 30, 40 together. After splicing the control lines 30, 40 end to end, the protective assembly 200 may be re-positioned over the splice 50 and secured in place through the use of the compression members 230.

Figure 4:
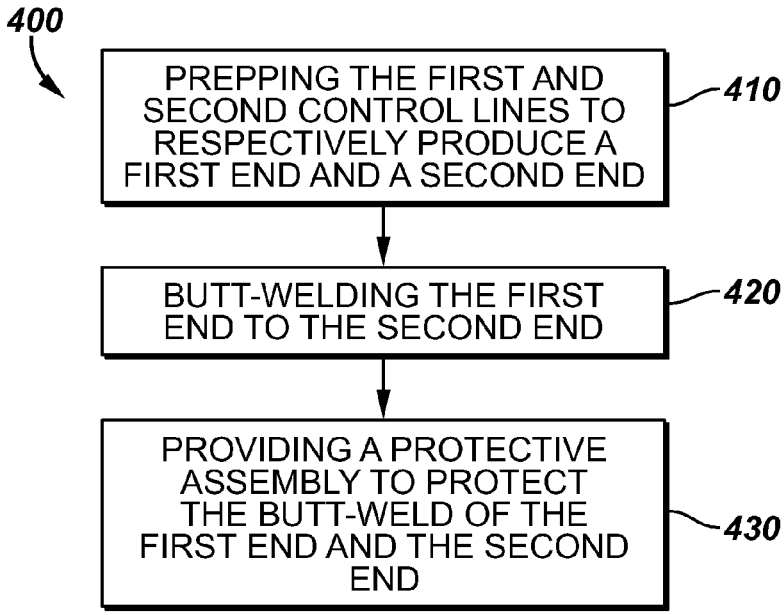
FIG. 4 is a flow diagram of a welding method in accordance with an embodiment of the invention.

Referring now to FIG. 4, this figure illustrates a flowchart representing an embodiment of a joining method 400 incorporating aspects of the current invention. The joining method 400 may comprise prepping the first and second control lines to respectively produce a first end and a second end, for example, such as by facing each of the first and second control lines, as indicated by block 410; butt-welding the first end to the second end and forming a splice, as indicated by block 420; and providing a protective assembly to protect the splice between the first end and the second end as indicated by block 430. Each of these steps will be described in more detail as follows.

Figure 5:
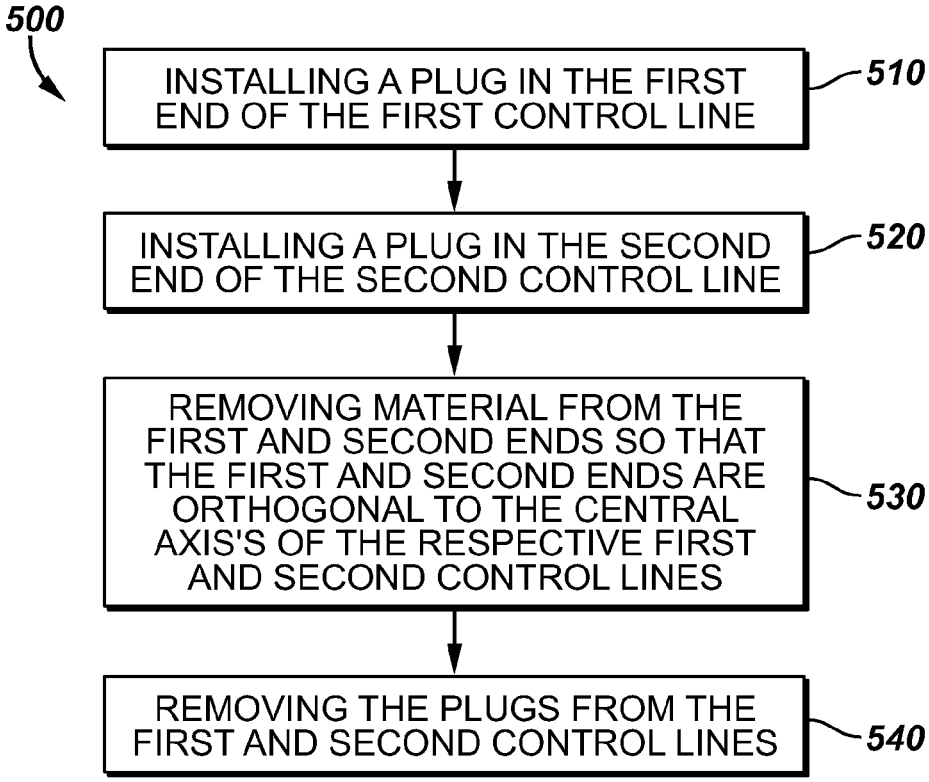
FIG. 5 is a flow diagram of a facing method in accordance with an embodiment of the invention.

Turning now to FIG. 5, this figure illustrates a flowchart representing an embodiment of the prepping element 410 (see FIG. 4) of an exemplary method of the current invention. Prepping may comprise installing a plug in the first end of the first control line, as indicated by block 510; installing a plug in the second end of the second control line, as indicated by block 520; removing material from the first and second ends so that the first and second ends are orthogonal to the central axes of the respective first and second control lines, as indicated by block 530; and removing the plug from the first end and the plug from the second end, as indicated by block 540. As shown in FIG. 2, the plug assemblies 100 may be installed and/or removed via a removal tool 150.

Figure 6:
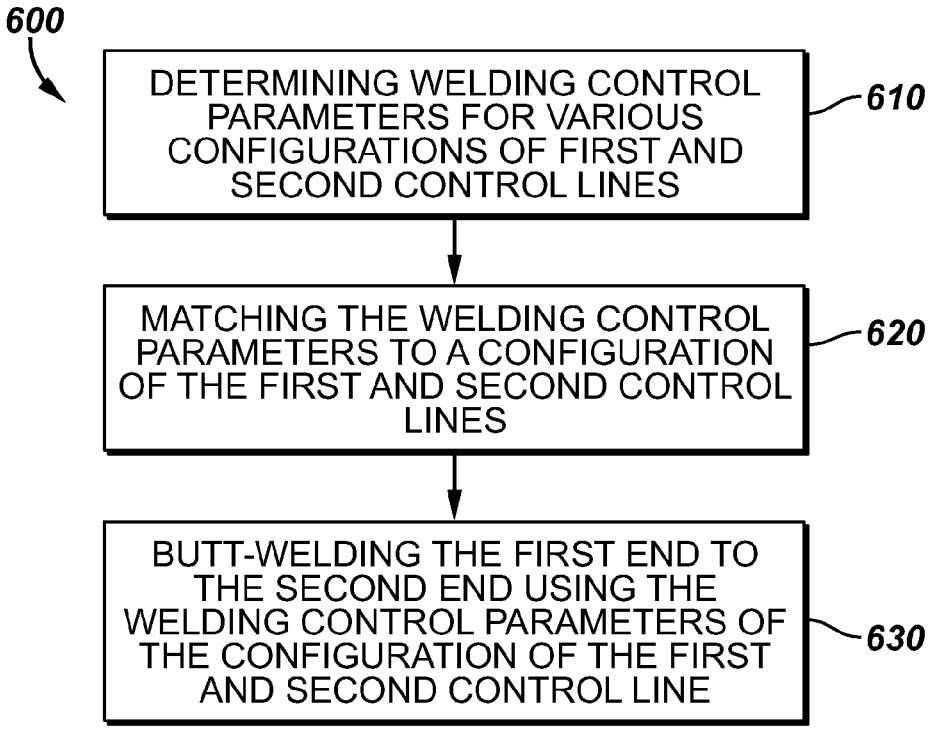
FIG. 6 is a flow diagram of a butt-welding method in accordance with an embodiment of the invention.

Referring now to FIG. 6, this figure illustrates a flowchart representing an embodiment of the butt-welding element 420 (see FIG. 4) of an exemplary method of the current invention. Butt-welding the first and second control lines together to form a splice may include determining the welding control parameters for various configurations of first and second control lines (i.e., sizes, types of materials, and environmental conditions, among others), as indicated by block 610; matching the welding control parameters to the configuration of the first and second control lines as indicated by block 620; and butt-welding the first end to the second end using the welding control parameters of the configuration of the first and second control lines, as indicated by block 630.

Figure 7:
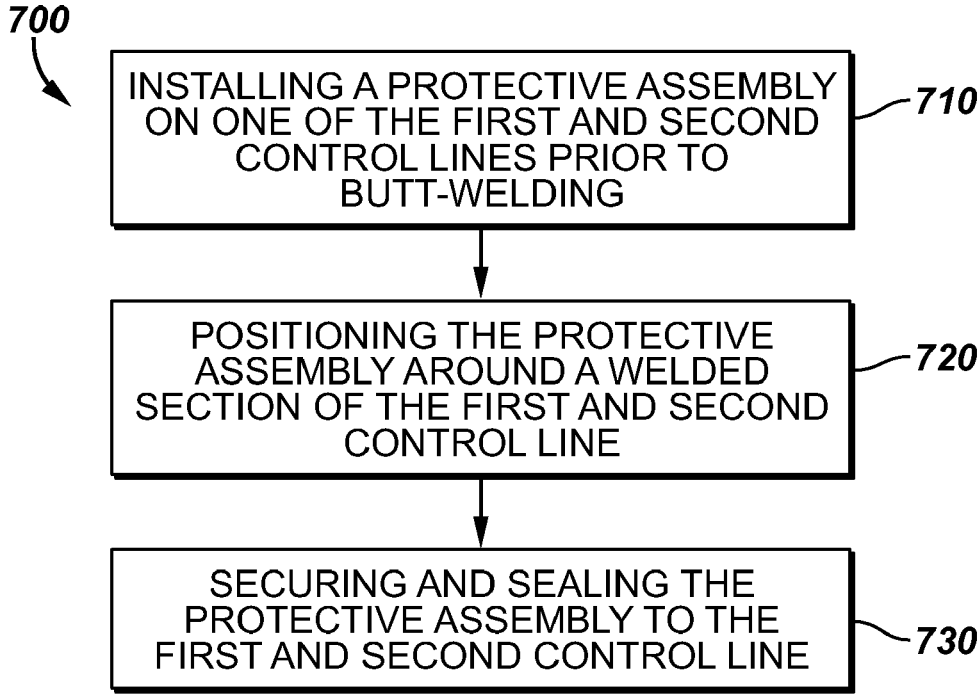
FIG. 7 is a flow diagram of a method for providing a protective assembly in accordance with an embodiment of the invention.

Turning now to FIG. 7, this figure illustrates a flowchart representing an embodiment of providing a protective assembly element 430 (see FIG. 4) of an exemplary method of the current invention. Providing a protective element 700 may comprise installing a protective assembly on one or both (i.e., the individual components of a protective assembly divided between the first and second control lines) of the first and second control lines prior to butt-welding them together, as indicated by block 710; positioning the protective assembly around a welded section of the first and second control line, as indicated by block 720; and securing and sealing the protective assembly to the first and second control line, as indicated by block 730. In some cases, the protective assembly may be used to pressure test the splice between the first and second control lines. In still other cases, the protective assembly may be used to contain an material configured to further increase insulative and/or stiffness properties of the protective assembly, e.g., the material may be an injectable material such as a stiffening agent.

Figure 8:
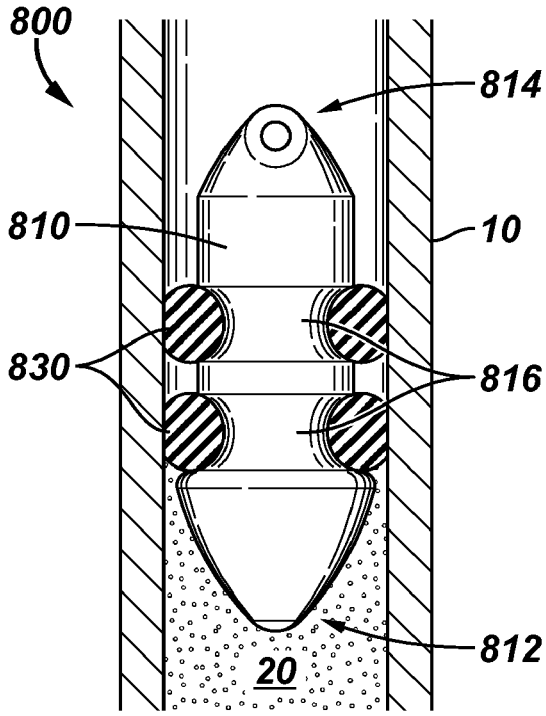
FIG. 8 is a cross-sectional view of a plug assembly provided in the end of a control line, in accordance with an embodiment of the invention.

Referring generally to FIG. 8, this figure illustrates another embodiment of a plug assembly 800 configured according to aspects of the current invention. As shown, the plug assembly 800 is configured to be translatably accommodated within a control line 10. In some cases, the control line 10 may contain fluid 20 such as hydraulic fluid for example, among other types of fluid.

The plug assembly 800 may comprise a plug member 810 and one or more seals 830. The plug member 810 may comprise a first plug end 812 and a second plug end 814. The first plug end 812 may be substantially conical and configured to translatably fit within the interior of the control line 10. However, many variations and modifications of the first plug end 812 are considered to be within the scope of the current invention, such as, but not limited to, combinations of arcuate and angled end surfaces designed to more easily engage with and enter into the control line 10. The second plug end 814 of the plug member 810 may comprise an orifice or other feature configured to be removably engaged with a removal tool (not shown, see FIG. 2 for an exemplary embodiment) for insertion and/or removal relative to the interior of the control line 10.

The plug member 810 may be substantially cylindrical and be configured to accommodate one or more seals 830 (two are shown in this illustrative example). In order to maintain the one or more seals 830 in position relative to the plug member 810, seal retention features 816 may be incorporated into the circumference and/or exterior surface of the plug member 810. In the exemplary embodiment shown, two indentations or grooves are shown as seal retention features 816. However, embodiments of the current invention may not be limited to this example. Other shapes, configurations, and geometries may be used to secure the seals 830 relative to the plug member 810, such as one or more protrusions, grooves, indentations, pins, bumps, or ridges, among other variations to the outer surface of the plug member 810.

The seals 830 may function to prevent control line fluid 20 from flowing past the plug assembly 800. In some cases, the seals 830 may act as wipers as they move debris and other contaminants, such as those produced by prepping the associated control line 10 ends, out from the interior of the control line 10 during removal of the plug assembly 800.

While the invention has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A method of coupling a first control line to a second control line comprising:

prepping the first and second control lines respectively producing a first end and a second end;

butt-welding the first end to the second end to form a splice; and providing a protective assembly to cover the splice;

wherein prepping comprises inserting a plug assembly into at least one of the first or second ends prior to facing the at least one of the first or second ends.

2. The method as recited in claim 1, wherein the plug assembly is inserted into each of the first and second ends prior to facing each of the first and second ends.

3. The method as recited in claim 1, wherein the plug assembly is removed from the at least one of the first or second ends prior to butt-welding the first end to the second end; and components of the protective assembly are placed on one or both of the first or second control lines prior to butt-welding the first end to the second end.

4. The method as recited in claim 1, wherein butt-welding the first end to the second end further comprises:

determining welding control parameters for various configurations of first and second control lines;

matching the welding control parameters to a configuration comprising the first and second control line; and butt-welding the first end to the second end using the welding control parameters of the configuration of the first and second control line.

5. The method as recited in claim 1, wherein plug assembly comprises:

a plug member;

at least one seal; and an end piece;

wherein the at least one seal is coupled to the plug member and retained through the use of the end piece.

6. The method as recited in claim 1, wherein the plug assembly further includes one or more sets of another seal and a spacer coupled to the plug member and retained through the use of the end piece.

7. The method as recited in claim 1, wherein the plug assembly comprises:

a plug member; and at least one seal;

wherein the at least one seal is coupled to the plug member and retained within a seal retention feature of the plug member.

8. The method as recited in claim 7, wherein two or more seals are coupled to the plug member.

9. The method as recited in claim 1 wherein a plug member of the plug assembly comprises a non-metallic material.

10. A plug assembly configured to be accommodated within a control line comprising:

a plug member;

at least one seal; and an end piece;

wherein the at least one seal is coupled to the plug member and retained through the use of the end piece and wherein the plug assembly further includes one or more sets of another seal and a spacer coupled to the plug member and retained through the use of the end piece.

11. The plug assembly as recited in claim 10, wherein the plug member is configured to be removably coupled with a tool for at least one of insertion or removal with regard to the control line.

12. The plug assembly as recited in claim 11, wherein the plug member comprises a threaded end for removably coupling the plug assembly with the tool.

13. The plug assembly as recited in claim 10, wherein an end of the plug member is conically shaped.

14. A method of coupling a first control line to a second control line comprising:

inserting a plug assembly into the first control line;

facing an end of the first control line to be substantially orthogonal to a central axis of the first control line;

removing the plug assembly from the first control line and inserting the plug assembly into the second control line;

facing an end of the second control line to be substantially orthogonal to a central axis of the second control line;

removing the plug assembly from the second control line;

providing components of a protective assembly onto at least one of the first control line or the second control line;

butt-welding the end of the first control line to the end of the second control line to form a splice;

positioning an assembled protective assembly over the splice; and securing the assembled protective assembly in place.

15. The method as recited in claim 14, wherein the plug assembly comprises:

a plug member;

a seal; and an end piece;

wherein the seal is provided between the plug member and the end piece.

16. The method as recited in claim 15, wherein the plug assembly further comprises at least one or more sets of another seal and spacer provided between the plug member and the end piece.

17. The method as recited in claim 14, wherein the plug assembly comprises:

a plug member; and a seal;

wherein the seal is coupled to the plug member through the use of a seal retention feature.

18. The method as recited in claim 17, wherein the plug assembly comprises two or more seals coupled to the plug member.

19. The method as recited in claim 17 wherein the seal retention feature comprises an indentation within the circumference of the plug member.

* * * * *